US006498001B1

(12) United States Patent
Bergthaller et al.

(10) Patent No.: US 6,498,001 B1
(45) Date of Patent: Dec. 24, 2002

(54) PHOTOGRAPHIC SILVER HALIDE EMULSION

(75) Inventors: Peter Bergthaller, Bergisch Gladbach (DE); Jörg Siegel, Köln (DE); Hans-Ulrich Borst, Elsdorf (DE); Ralf Büscher, Lohmar (DE); Ulrich Nickel, Erlangen (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/911,589

(22) Filed: Jul. 24, 2001

(30) Foreign Application Priority Data

Jul. 26, 2000 (DE) ..... 100 36 326

(51) Int. Cl.[7] ..... G03C 1/005; G03C 1/494

(52) U.S. Cl. ..... 430/573; 430/566; 430/567; 430/570; 430/572; 430/607; 430/613; 430/614

(58) Field of Search ..... 430/566, 567, 430/570, 572, 273, 607, 613, 614

(56) References Cited

U.S. PATENT DOCUMENTS 4,128,425 A * 12/1978 Greenwald ..... 430/239

FOREIGN PATENT DOCUMENTS

| | | | |
|---|---|---|---|
| JP | 090120132 | * | 5/1997 |
| JP | 10026811 | * | 1/1998 |
| JP | 10055040 | * | 2/1998 |

* cited by examiner

*Primary Examiner*—Geraldine Letscher
(74) *Attorney, Agent, or Firm*—Connolly Bove Lodge & Hutz LLP

(57) ABSTRACT

A spectrally sensitized photographic silver halide emulsion, characterized in that after precipitation at least one compound of formula (I)

is added to the emulsion, wherein $R^1$ denotes alkyl, aryl, aralkyl, alkenyl or heterocyclyl;

$R^2$ denotes H, alkyl, aryl, heterocyclyl, amino or alkoxy;

$R^3$ denotes H, alkyl, aryl, aralkyl or heterocyclyl;

D denotes —OH or —$NR^4R^5$;

X denotes O or N—$R^6$;

$R^4$ denotes H, alkyl, aryl, aralkyl, alkenyl or heterocyclyl;

$R^5$: denotes H, alkyl, aryl, aralkyl, alkenyl or heterocyclyl;

$R^6$: denotes H, alkyl, aryl, aralkyl, alkenyl, acyl, alkoxycarbonyl, carbamoyl or heterocyclyl, the aforementioned alkyl, aryl, aralkyl, alkenyl, heterocyclyl, amino, alkoxy, acyl, alkoxycarbonyl and carbamoyl groups can be substituted, and any two of the radicals $R^1$ to $R^6$ can together form a heterocyclic ring, such as a pyrrolidine, piperidine, perhydroazepine, piperazine, morpholine or thiomorpholine ring, for example; as well as a photographic material comprising a support and at least one silver halide emulsion layer which contains said emulsion, are distinguished by increased sensitivity, a high sensitivity/fogging ratio and a good shelf life, particularly when stored under humid climatic conditions.

15 Claims, No Drawings

PHOTOGRAPHIC SILVER HALIDE EMULSION

This invention relates to a spectrally sensitised silver halide emulsion, and to a photographic material comprising a support and at least one layer which comprises at least one spectrally sensitised silver halide emulsion.

It is known that spectrally sensitised emulsions can be supersensitised by depositing compounds apart from sensitisers, particularly additional dyes, on the surface of the silver halide crystals, which compounds are capable of increasing the spectrally sensitised sensitivity. Ascorbic acid is a typical example of such compounds. Other suitable compounds are disclosed in U.S. Pat. Nos. 2,945,762, 3,695,888, 3,809,561 and 4,011,083. The supersensitisation of silver halide emulsions with catechol sulphonic acids is also known. The aforementioned compounds do have a supersensitising effect, but result in an unwanted increase in fogging.

U.S. Pat. No. 5,457,022 describes supersensitisation by metallocenes. These are aromatic transition metal complexes of cyclopentadiene and derivatives thereof which have a characteristic "sandwich structure" without a direct metal-carbon σ bond. The best known of these compounds are bis-(cyclopentadienyl)iron (ferrocene) and derivatives thereof. One disadvantage is that supersensitisation with ferrocenes results either in an unsatisfactory increase in sensitivity or is associated with an increase in fogging, during storage at the latest, due to which any increase in sensitivity is lost again.

Moreover, the use of pyrazoline compounds as a measure for increasing the granularity of colour photographic recording materials is known from DE 19,642,532. These are described there as protective additives, but are not necessarily used in layers which contain emulsions. A sensitivity-enhancing effect is not determined.

With these known measures, however, no success has been achieved in obtaining emulsions, such as those which are required nowadays for high-speed photographic materials, which comprise a very high spectral sensitivity together with reduced fogging and a good shelf life, particularly when they are stored under humid climatic conditions.

The underlying object of the present invention is thus to identify spectrally sensitised photographic silver halide emulsions of increased spectral sensitivity which furthermore are distinguished by a high sensitivity/fogging ratio and by a good shelf life, particularly when stored under humid climatic conditions.

It has surprisingly been found that this object can be achieved by the addition of certain pyrazoline compounds, if the latter are added to the light-sensitive emulsion in the interval between the completion of precipitation and the completion of spectral sensitisation.

The present invention therefor relates to a spectrally sensitised photographic silver halide emulsion, characterised in that after precipitation at least one compound of formula (I)

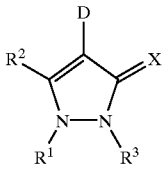

is added to the emulsion, wherein $R^1$ denotes alkyl, aryl, aralkyl, alkenyl or heterocyclyl;

$R^2$ denotes H, alkyl, aryl, heterocyclyl, amino or alkoxy;

$R^3$ denotes H, alkyl, aryl, aralkyl or heterocyclyl;

D denotes —OH or —$NR^4R^5$;

X denotes O or N—$R^6$;

$R^4$ denotes H, alkyl, aryl, aralkyl, alkenyl or heterocyclyl;

$R^5$: denotes H, alkyl, aryl, aralkyl, alkenyl or heterocyclyl;

$R^6$: denotes H, alkyl, aryl, aralkyl, alkenyl, Acyl, alkoxycarbonyl, carbamoyl or heterocyclyl, and any two of the radicals $R^1$ to $R^6$ can together form a heterocyclic ring, such as a pyrrolidine, piperidine, perhydroazepine, piperazine, morpholine or thiomorpholine ring.

Of the possible rings formed by the radicals $R^1$ to $R^6$, 5- to 7-membered rings are preferred.

The alkyl, aralkyl and alkenyl radicals in the sense of the present invention can be straight chain, branched or cyclic radicals. The alkyl, aryl, aralkyl, alkenyl, hetero-cyclyl, amino, alkoxy, acyl, alkoxycarbonyl and carbamoyl groups can be substituted, for example, by alkyl, aryl, heterocyclyl, hydroxy, carboxy, halogen, alkoxy, aryloxy, heterocyclyloxy, alkylthio, arylthio, heterocyclylthio, acyl, acyloxy, acylamino, cyano, nitro, or mercapto groups, wherein the term "heterocyclyl" represents a saturated, unsaturated or aromatic heterocycle and the term "acyl" represents the radical of an aliphatic, olefinic or aromatic carboxylic, carbamic, carbonic, sulphonic, amidosulphonic, phosphoric, phosphonic, phosphorous phosphinic or sulphinic acid.

Examples of preferred compounds of formula I are given below:

I-1

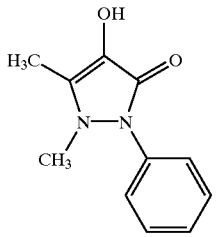

I-2

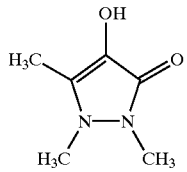

-continued
I-3
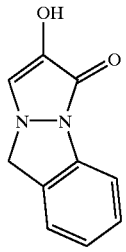
I-4
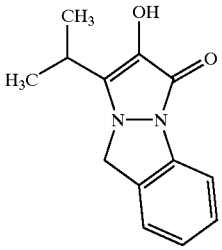
I-5
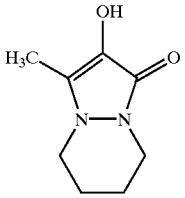
I-6
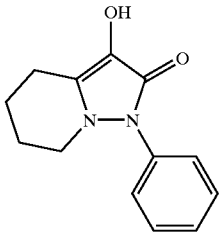
I-7
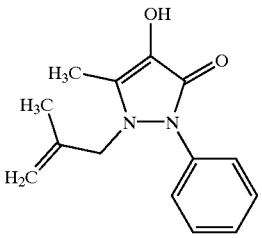
I-8
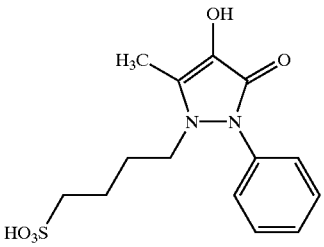
-continued
I-9
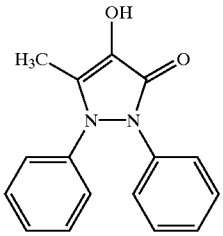
I-10
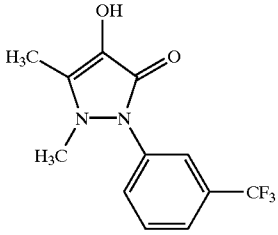
I-11
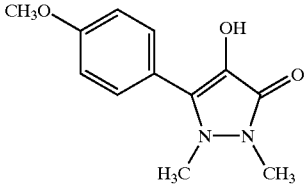
I-12
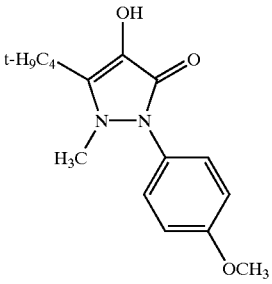
I-13
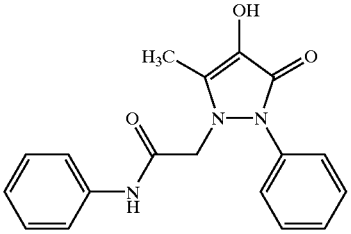
I-14
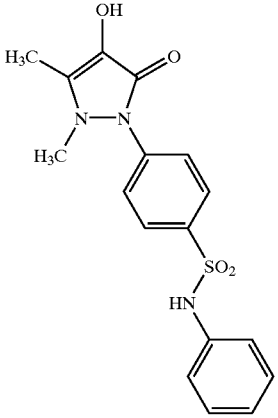

-continued
I-15
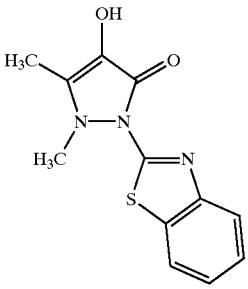
I-16
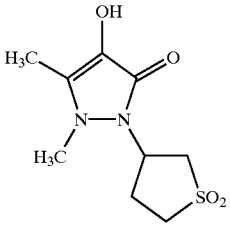
I-17
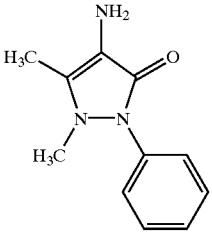
I-18
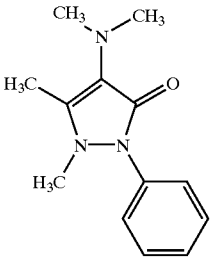
I-19
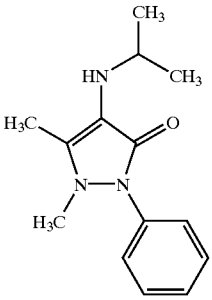
-continued
I-20
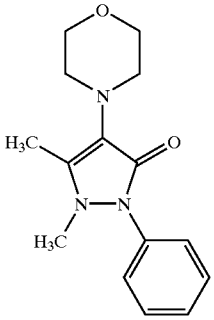
I-21
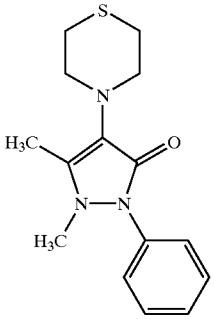
I-22
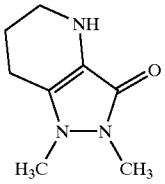
I-23
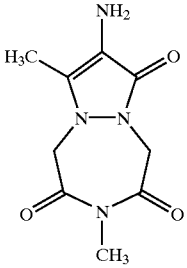
I-24
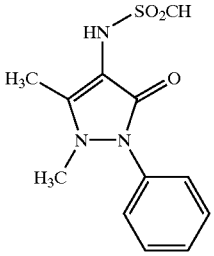
I-25
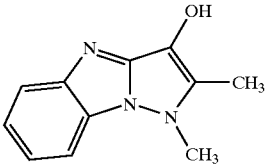

-continued
I-26
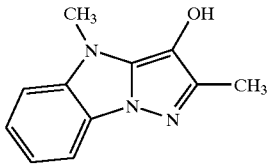
I-27
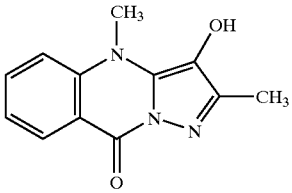
I-28
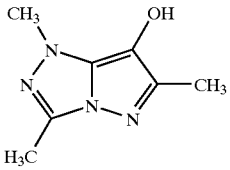
I-29
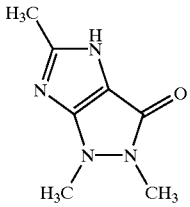
I-30
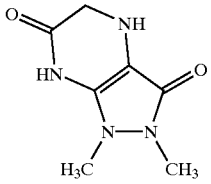
I-31
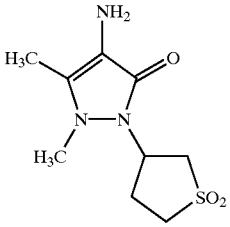
I-32
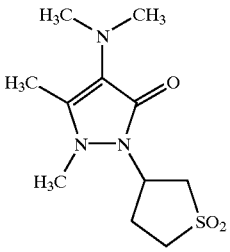
-continued
I-33
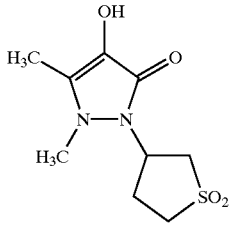
I-34
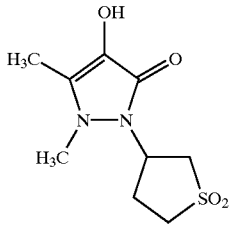
I-35
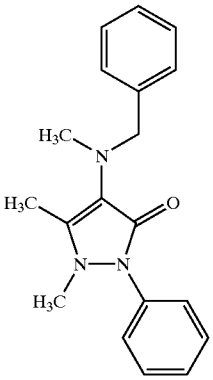
I-36
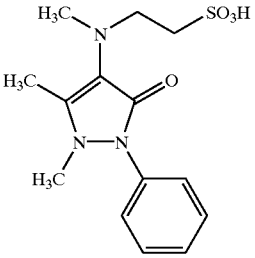
I-37
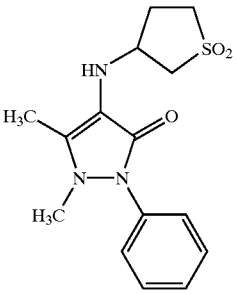

-continued

I-38

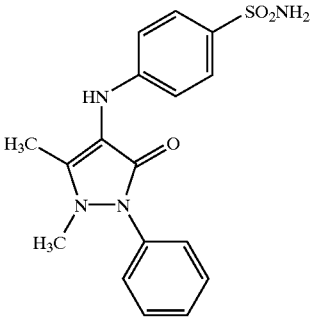

I-39

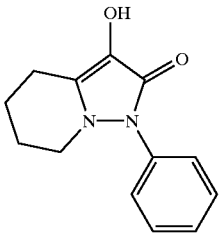

I-40

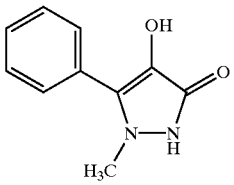

I-41

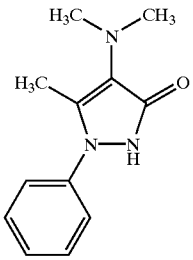

I-42

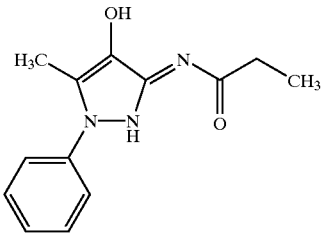

I-43

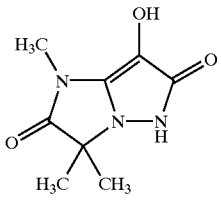

Compounds I-1 and I-18 are particularly preferred.

The production of compounds of formula (I) has been described many times, for example by Hukki, Pharmazeutica Acta Helvetiae, pages 704–712 (1986), by Hukki, Acta Chem. Scand. 13, pages 174–177 (1959) and by Bockmühl M., Med. u. Chem. Abhandl. med. chem. Forschungsstätten IG Farbenind. 3, page 294 (1936).

Depending on their substituents, the heterocyclic compounds of formula I according to the invention are hydrophobic to a greater or lesser extent, at least in the form in which they are present in the silver halide. However, they can also be hydrophilic, in the presence of anionisable groups for example. Moreover, in one preferred embodiment they can contain specific groups which improve their adsorption on silver halides, e.g. thioether, selenoether, thione, thiol or amine radicals.

The preferred compounds of formula (I) are characterised in that their redox potential in aqueous solution within the pH range between 5 and 7 differs by no more than +/−100 mV from the standard potential of the hydrogen electrode. In photographic materials, compounds with a potential more negative than −100 mV can easily result in an increase in minimum density. Compounds with a potential which is more positive than +100 mV, in combination with special spectral sensitisers, exhibit a loss of efficacy. The redox potential of a compound I can generally readily be determined by cyclic voltammetry, provided that the redox reaction proceeds at least approximately reversibly.

Compounds of formula (I) are preferably used in an amount of $10^{-6}$ to $10^{-2}$ mol per mol silver halide and can be added to the emulsion to be sensitised before, during or after the addition of dyes, either as a solution or as a dispersion of solids. Compounds of the of formula (I) are preferably added after desalination of the emulsion. It is particularly advantageous if at least one compound of formula I is added to the emulsion directly before the addition of at least one spectral sensitiser or together with at least one spectral sensitiser.

In a further, particularly preferred embodiment, a compound of formula (I) is added to the emulsion directly before or during chemical sensitisation.

Spectrally sensitising dyes which can be used in the presence of compounds according to the invention are to be found in the series comprising the polymethine dyes. Examples of these dyes are described by T. H. James in The Theory of the Photographic Process, $4^{th}$ Edition 1977, Macmillan Publishing Co., pages 194 to 234.

These dyes are capable of sensitising silver halide over the entire range of the visible spectrum and furthermore over the infrared-and/or ultraviolet range. Particularly preferred dyes include mono-, tri- and pentamethine cyanines, the chromophore of which comprises two heterocycles which, independently of each other, can be benzoxazole, benzimidazole, benzthiazole, naphthoxazole, naphthiazole or benzo-selenazole, and the phenyl ring of each of these heterocycles can contain further substituents or further conjoined rings or ring systems. The preferred pentamethine cyanines in turn are those in which the methine part is a constituent of a partially unsaturated ring. The dyes can be cationic, can be uncharged in the form of betaines or sulphobetaines, or can be anionic. Compared with the dye concentration which was found to be the optimum for the respective emulsion without compounds of formula (I) according to the invention, the amount of dye can be increased about 1.5- to 2-fold in the presence of compounds according to the invention. The spectrally sensitising dye or spectrally sensitising dyes are preferably used in a total amount of $10^{-6}$ to $10^{-2}$ mol per mol silver halide, most preferably in an amount of $10^{-4}$ to $10^{-2}$ mol per mol silver halide.

Silver halide emulsions in the sense of the invention can be prepared by known methods such as conventional precipitation, single- to multiple double inlet methods, conversion, re-dissolution of a fine grained emulsion (micrate re-dissolution), and by any combination of these methods.

The emulsions according to the invention are preferably silver bromide, silver bromide-iodide or silver bromide-chloride-iodide emulsions with an iodide content of 0 to 15 mol % and a chloride content of 0 to 20 mol %, or are silver chloride, silver chloride-bromide, silver chloride-iodide or silver chloride-bromide-iodide emulsions with a chloride content of at least 50 mol %.

The crystals can be intrinsically homogenous or can be inhomogeneous in the form of zones; they can be single crystals or singly- or multiply-twinned crystals. The emulsions can consist of predominantly compact, predominantly rod-like or predominantly lamellar crystals.

Emulsions are preferred in which at least 50% of the projected area consists of tabular crystals with an average aspect ratio of at least 3. In a most preferred embodiment, the average aspect ratio of the crystals ranges between 4 and 12, and in a further most preferred embodiment the crystals are hexagonal crystals with an average side to length ratio between 1.0 and 2.0. It is even more advantageous if the proportion of tabular crystals amounts to at least 70% of the projected area of the emulsion. The term "aspect ratio" is to be understood to mean the ratio of the diameter of the circle of equivalent area to the projected surface of the crystal to the thickness of the crystal. The side to length ratio is defined as the highest ratio of the lengths of two adjacent crystal faces which occurs in a crystal, wherein it is only the edges of tabular crystals which are taken into consideration; geometrically perfect hexagonal platelets have a side to length ratio of 1.0.

The emulsions can be monodisperse or polydisperse. Emulsions are preferred in which the crystals have a narrow grain size distribution V.

The distribution width V of an emulsion is defined as $$V\ [\%] = \frac{\text{standard deviation of the grain size distribution} \times 100}{\text{average grain size}}$$

Crystals with a distribution width V≦25% are preferred, particularly those with a distribution width V≦20%.

The emulsion crystals can also be doped with certain extraneous ions, particularly with polyvalent transition metal cations or complexes thereof. In one preferred embodiment, for example, hexacyanoferrate(II) ions or trivalent noble metal cations which comprise an octahedral ligand environment are used for this purpose, such as ruthenium(III), rhodium(III), osmium(III) or iridium(III).

The emulsions can be chemically sensitised in a conventional manner, e.g. by preparing them in the presence of ammonia or amines, by sulphur ripening, selenium ripening, tellurium ripening or ripening with gold compounds, and also be ripening with reducing ripening agents. Reduction ripening can also be carried out in the course of precipitating emulsion crystals in the interior of the crystals, wherein the reduction ripening nuclei are covered during the further growth of the crystals. Divalent tin compounds, N-arylhydrazides, salts of formamidinesulphinic acid and borohydrides or borane complexes can advantageously be used as reduction ripening agents. Thioureas and selenoureas can also act as reduction ripening agents. Organic and water-soluble reduction ripening agents which are rapidly and completely adsorbed on the silver halide are preferred. Different methods of ripening can also be combined.

The supersensitisation of spectrally sensitised emulsions with compounds corresponding to formula (I) in combination with the stabilisation of the photographic material by palladium(II) compounds is particularly advantageous.

Examples of colour photographic materials include colour negative films, colour reversal films, colour positive films, colour photographic paper, colour reversal photographic paper, and colour-sensitive materials for the colour diffusion transfer process or the silver halide bleaching process.

Photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Colour photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films and colour reversal films comprise, in the following sequence on their support: 2 or 3 red-sensitive, cyan-coupling silver halide emulsion layers, 2 or 3 green-sensitive, magenta coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf. Rec. Mats., 1994, Vol. 22, pages 183–193, and in Research Disclosure 38957, Part XI (1996), page 624.

Colour photographic paper, which as a rule is less sensitive to light than is colour photographic film, usually comprises the following layers on the support, in the following sequence: a blue-sensitive, yellow-coupling silver halide emulsion layer, a green-sensitive, magenta coupling silver halide emulsion layer, and a red-sensitive, cyan-coupling silver halide emulsion layer. The yellow filter layer can be omitted.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layer are binders, silver halide grains and colour couplers.

Information on suitable binders is given in Research Disclosure 37254, Part 2 (1995), page 286, and in Research Disclosure 38957, Part IIA (1996), page 598.

Information on suitable silver halide emulsions, their production, ripening, stabilisation and spectral sensitisation, including suitable spectral sensitisers, is given in Research Disclosure 37254, Part 3 (1995), page 286, in Research Disclosure 37038, Part XV (1995), page 89, and in Research Disclosure 38957, Part VA (1996), page 603.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mol % AgBr, or silver chloride-bromide emulsions comprising more than 95 mol % AgCl.

Information on colour couplers is to be found in Research Disclosure 37254, Part 4 (1995), page 288, in Research Disclosure 37038, Part II (1995), page 80, and in Research Disclosure 38957, Part XB (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part XC (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part XD (1996), page 621.

The photographic material may additionally contain compounds which absorb UV light, brighteners, spacers, filter dyes, formalin scavengers, light stabilisers, anti-oxidants, $D_{Min}$ dyes, additives for improving the dye-, coupler- and white stability and to reduce colour fogging, plasticisers (latices), biocides and other substances.

Suitable compounds are given in Research Disclosure 37254, Part 8 (1995), page 292, in Research Disclosure 37038, Parts IV, V, VI, VII, X, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part IIB (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996), page 630 et seq., together with examples of materials.

EXAMPLES

The desalinated silver halide emulsions cited in Examples 1 to 3 were adjusted to the values of ripening temperature, pH and UAg given in Tables 1 to 3 below, were optionally subsequently treated with a compound of formula I according to the invention, and thereafter were optionally ripened with a spectral sensitiser (RS-1, GS-1 or BS-1) and with the ripening agents sodium thiosulphate, optionally triphenylphosphane selenide (TPS), potassium thiocyanate and tetrachloroauric acid to achieve the optimum spectral sensitivity. The compounds according to the invention and the spectral sensitisers which were used in each case, as well as all the amounts of substances used, are given in Tables 1 to 3. The amount of sensitiser "before ripening" which is given in the Tables was used directly before the addition of the ripening agents in each case. In contrast, the amount of sensitiser "after ripening" given in the Tables was not added until the sensitivity optimum had been reached.

After the addition of 4 mmol 4-hydroxy-6-methyl-1,3,3a,7-tetraazaindene per mol Ag, of 120 $\mu$mol 2-mercaptobenzoxazole per mol Ag, and of a colour coupler emulsion, the sensitised emulsions were deposited in the following amounts on a supporting substrate made of cellulose triacetate, of thickness 120 $\mu$m.

| | |
|---|---|
| cyan coupler C-1 | 0.30 g/m$^2$ |
| tricresyl phosphate | 0.45 g/m$^2$ |
| gelatine | 0.70 g/m$^2$ |
| silver halide emulsion | 0.85 g $AgNO_3$/m$^2$ |

A protective layer of the following composition was deposited thereon:

hardener H1: 0.02 g/m$^2$ gelatine: 0.01 g/m$^2$

Individual specimens were exposed to daylight behind an orange filter and a graduated neutral wedge filter and were subsequently processed using the process described in "The British Journal of Photography" 1974, page 597. The sensitivities were each determined in relative DIN units by densitometry measurements at a density of 0.2 above Dmin, and the fogging was determined as 1000 times the Dmin value. The results are listed in Tables 1 to 3.

The behaviour on storage of the film layers was assessed using an accelerated test. For this purpose, the layers were stored for 3 days at 60° C. and 90% atmospheric humidity, were subsequently exposed, and the sensitivity ($E_{Tr}$) and fogging ($S_{Tr}$) were determined as described above. These results are also listed in Tables 1 to 3.

Substances used in the examples:

C-1

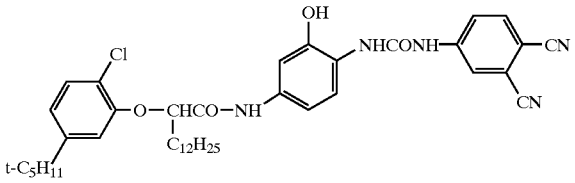

H-1

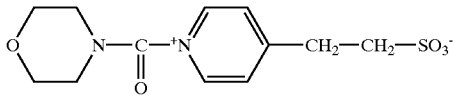

RS-1

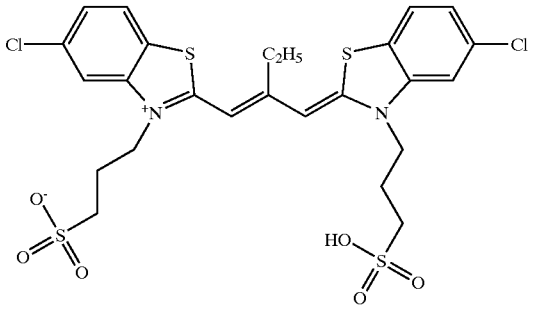

GS-1

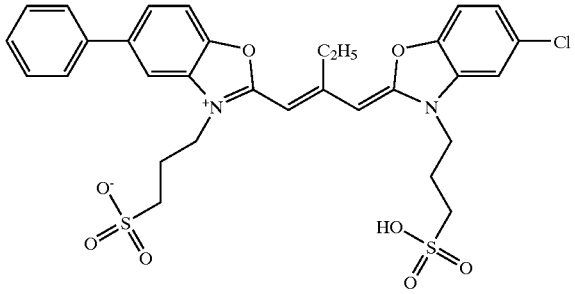

BS-1

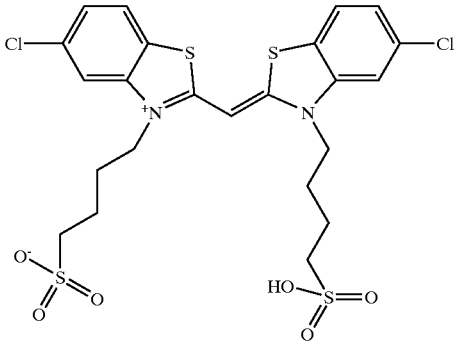

Example 1

A lamellar Ag(Br, I) emulsion (95 mol % bromide, 5 mol % iodide) was used which had an aspect ratio of 4.5 and an average grain diameter of 0.45 μm.

TABLE 1

| | Em-1/1 | Em-1/2 | Em-1/3 | Em-1/4 | Em-1/5 |
|---|---|---|---|---|---|
| Ripening temperature [° C.] | 48 | 48 | 48 | 48 | 48 |
| pH | 6 | 6 | 6 | 6 | 6 |
| $U_{Ag}$ [mV] | 90 | 90 | 90 | 90 | 90 |
| Pyrazoline | — | I-1 | I-6 | I-8 | I-35 |
| Quantity of pyrazoline [μmol/mol Ag] | 0 | 25 | 30 | 100 | 60 |
| Quantity of RS-1 before ripening [μmol/mol Ag] | 450 | 450 | 450 | 450 | 450 |
| $Na_2S_2O_3$ [μmol/mol Ag] | 25 | 25 | 25 | 25 | 25 |
| KSCN [μmol/mol Ag] | 650 | 650 | 650 | 650 | 650 |
| $HAuCl_4$ [μmol/mol Ag] | 5 | 5 | 5 | 5 | 5 |
| Sensitivity | 41.2 | 42.1 | 42.4 | 41.8 | 42.4 |
| Fogging | 23 | 19 | 22 | 23 | 22 |
| $E_{Tr}$ | 40.1 | 41.8 | 42.0 | 41.5 | 42.1 |
| $S_{Tr}$ | 39 | 23 | 29 | 27 | 26 |

Em-1/1 comparison
Em-1/2 to Em-1/5 invention

Example 2

A lamellar Ag(Br, I) emulsion (93 mol % bromide, 7 mol % iodide) was used which had an aspect ratio of 8.1 and an average grain diameter of 0.58 μm.

TABLE 2

| | Em-2/1 | Em-2/2 | Em-2/3 | Em-2/4 | Em-2/5 |
|---|---|---|---|---|---|
| Ripening temperature [° C.] | 51 | 51 | 51 | 51 | 51 |
| pH | 6.5 | 6.5 | 6.5 | 6.5 | 6.5 |
| $U_{Ag}$ [mV] | 105 | 105 | 105 | 105 | 105 |
| Pyrazoline | — | I-3 | I-7 | I-9 | I-40 |
| Quantity of pyrazoline [μmol/mol Ag] | 0 | 150 | 100 | 80 | 100 |
| Quantity of GS-1 before ripening [μmol/mol Ag] | 0 | 600 | 600 | 600 | 600 |
| $Na_2S_2O_3$ [μmol/mol Ag] | 30 | 15 | 30 | 25 | 25 |
| TPS [μmol/mol Ag] | 0 | 15 | 0 | 5 | 5 |
| KSCN [μmol/mol Ag] | 750 | 750 | 750 | 750 | 750 |
| $HAuCl_4$ [μmol/mol Ag] | 5.5 | 5.5 | 5.5 | 5.5 | 5.5 |
| Quantity of GS-1 after ripening [μmol/mol Ag] | 600 | 0 | 0 | 0 | 0 |
| Sensitivity | 42.6 | 43.5 | 43.8 | 43.1 | 43.6 |
| Fogging | 23 | 25 | 21 | 24 | 20 |
| $E_{Tr}$ | 41.1 | 42.8 | 43.3 | 42.2 | 42.7 |
| $S_{Tr}$ | 33 | 33 | 29 | 28 | 27 |

Em-2/1 comparison
Em-2/2 to Em-2/5 invention

Example 3

A lamellar Ag(Br, I) emulsion (92 mol % bromide, 8 mol % iodide) was used which had an aspect ratio of 10.1 and an average grain diameter of 0.41 μm.

TABLE 3

| | Em-3/1 | Em-3/2 | Em-3/3 | Em-3/4 | Em-3/5 |
|---|---|---|---|---|---|
| Ripening temperature [° C.] | 49 | 49 | 49 | 49 | 49 |
| pH | 6.3 | 6.3 | 6.3 | 6.3 | 6.3 |
| $U_{Ag}$ [mV] | 95 | 95 | 95 | 95 | 95 |
| Pyrazoline | — | I-2 | I-5 | I-8 | I-42 |
| Quantity of pyrazine [μmol/mol Ag] | 0 | 100 | 120 | 80 | 100 |

TABLE 3-continued

| | Em-3/1 | Em-3/2 | Em-3/3 | Em-3/4 | Em-3/5 |
|---|---|---|---|---|---|
| BS-1 before ripening [μmol/mol Ag] | 0 | 1000 | 1000 | 1000 | 1000 |
| $Na_2S_2O_3$ [μmol/mol Ag] | 48 | 48 | 48 | 48 | 48 |
| KSCN [μmol/mol Ag] | 950 | 950 | 950 | 950 | 950 |
| $HAuCl_4$ [μmol/mol Ag] | 6.5 | 6.5 | 6.5 | 6.5 | 6.5 |
| Quantity of BS-1 after ripening [μmol/mol Ag] | 1000 | 0 | 0 | 0 | 0 |
| Senstivity | 42.6 | 43.8 | 43.5 | 43.9 | 43.8 |
| Fogging | 23 | 24 | 22 | 26 | 25 |
| $E_{Tr}$ | 40.9 | 43.0 | 42.6 | 43.0 | 42.8 |
| $S_{Tr}$ | 39 | 29 | 30 | 30 | 32 |

Em-3/1 comparison
Em-3/2 to Em-3/5 invention

The test results listed in Tables 1 to 3 show that by adding compounds according to the invention at defined times during the production of the emulsion, preferably in the course of spectral and/or chemical sensitisation, an increase in spectrally sensitised sensitivity is achieved. The magnitude of the sensitivity or speed which is additionally obtained amounts to up to half a stop.

What is claimed is:

1. A spectrally sensitized photographic silver halide emulsion which comprises precipitating the silver halide emulsion and after precipitation at least one compound of formula (I)

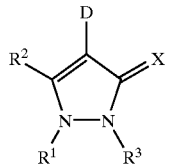

is added to the emulsion, wherein $R^1$ is alkyl, aryl, aralkyl, alkenyl or heterocyclyl;

$R^2$ is H, alkyl, aryl, heterocyclyl, amino or alkoxy;

$R^3$ is H, alkyl, aryl, aralkyl or heterocyclyl;

D is —OH or —$NR^4R^5$;

X is O or N—$R^6$;

$R^4$ is H, alkyl, aryl, aralkyl, alkenyl or heterocyclyl;

$R^5$ is H, alkyl, aryl, aralkyl, alkenyl or heterocyclyl;

$R^6$ is H, alkyl, aryl, aralkyl, alkenyl, acyl, alkoxycarbonyl, carbamoyl or heterocyclyl, the aforementioned alkyl, aryl, aralkyl, alkenyl, heterocyclyl, amino, alkoxy, acyl, alkoxycarbonyl and carbamoyl groups are optionally substituted and any two of the radicals $R^1$ to $R^6$ optionally together form a heterocyclic ring.

2. The silver halide emulsion according to claim 1, wherein $10^{-6}$ to $10^{-2}$ mol of the compound of formula (I) is added to the emulsion per mol silver after the desalination of the emulsion.

3. The silver halide emulsion according to claim 1, wherein the compound of formula I is added to the silver halide emulsion directly before the addition of at least one spectral sensitizer or together with at least one spectral sensitizer.

4. The silver halide emulsion according to claim 1, wherein the compound of formula (I) is added to the silver halide emulsion directly before or during chemical sensitization.

5. The silver halide emulsion according to claim 1, wherein the compound of formula (I) has a redox potential in aqueous solution within the pH range between 5 and 7 which differs by not more than +/−100 mV from the standard potential of the hydrogen electrode.

6. The silver halide emulsion according to claim 1, wherein the emulsion contains $10^{-6}$ to $10^{-2}$ mol of a spectral sensitizer or of a mixture of spectral sensitizers per mol silver.

7. The silver halide emulsion according to claim 1, wherein the emulsion is a silver bromide, silver bromide-iodide or silver bromide-chloride-iodide emulsion with an iodide content of 0 to 15 mol-% and a chloride content of 0 to 20 mol %, or a silver chloride, silver chloride-bromide, silver chloride-iodide or silver chloride-bromide-iodide emulsion with a chloride content of at least 50 mol %.

8. The silver halide emulsion according to claim 1, wherein at least 50% of the projected area of the silver halide emulsion consists of tabular crystals with an average aspect ratio of at least 3 and a grain size distribution width V of ≦25%.

9. The silver halide emulsion according to claim 1, wherein the crystals of the emulsion are doped with polyvalent transition metal cations or complexes thereof.

10. A photographic material comprising a support and at least one silver halide emulsion layer, and the at least one emulsion layer contains at least one of the silver halide emulsion according to claim 1.

11. The silver halide emulsion according to claim 1, wherein two of the radicals $R^1$ to $R^6$ together form a pyrrolidine, piperidine, perhydroazepine, piperazine, morpholine or thiomorpholine ring.

12. The silver halide emulsion according to claim 1, wherein two of the radicals $R^1$ to $R^6$ form a five- to seven-membered ring.

13. The silver halide emulsion according to claim 1, wherein the compound of the formula I is I-1 or I-18

I-1

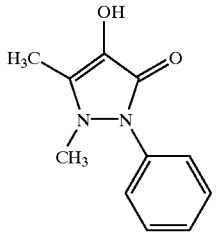

I-18

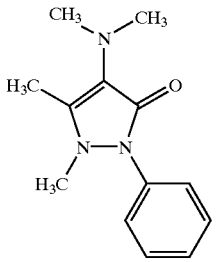

14. The silver halide emulsion according to claim 8, wherein at least 70% of the projected area of the silver halide emulsion consists of tabular crystals with an aspect ratio between 4 and 12 and the crystals are hexagonal crystals with an average size to length ratio between 1.0 and 2.0.

15. The silver halide emulsion according to claim 14, wherein the grain size distribution width V is≦20%.

* * * * *